United States Patent [19]

Maitra

[11] 4,037,648

[45] July 26, 1977

[54] METHOD OF COOLING RECOVERED SAND FOR CASTING PURPOSES AND APPARATUS THEREFOR

[75] Inventor: Sisir Kumar Maitra, Hamburg-Oststeinbek, Germany

[73] Assignee: Alfred Gutmann Gesellschaft fur Maschinenbau, Hamburg, Germany

[21] Appl. No.: 564,904

[22] Filed: Apr. 3, 1975

[30] Foreign Application Priority Data

Oct. 2, 1974 Germany ..... 2447008

[51] Int. Cl.[2] ..... F28F 28/00

[52] U.S. Cl. ..... 165/13; 34/56; 34/177

[58] Field of Search ..... 34/177, 55, 56, 13; 164/5; 210/33, 189, 71

[56] References Cited

U.S. PATENT DOCUMENTS

| | | | |
|---|---|---|---|
| 1,346,238 | 7/1920 | Nagel | 34/177 |
| 1,673,241 | 6/1928 | Hatfield | 34/56 |
| 1,941,499 | 1/1934 | Siems | 34/56 |
| 2,340,345 | 2/1944 | Richeson | 34/56 |
| 3,090,131 | 5/1963 | Waterman | 34/177 |
| 3,762,065 | 10/1973 | Wahlgren | 34/177 |

*Primary Examiner*—Carroll B. Dority, Jr.
*Assistant Examiner*—Daniel J. O'Connor
*Attorney, Agent, or Firm*—H. Dale Palmatier

[57] ABSTRACT

Method and apparatus for the substantially continuous cooling of recovered casting sand in discrete compartments of a bunker whereby the sand in each compartment is cooled while substantially at rest in heat exchange relation with heat exchanger means disposed within the compartment, and the sand thoughput through the compartments is controlled by gates.

5 Claims, 3 Drawing Figures

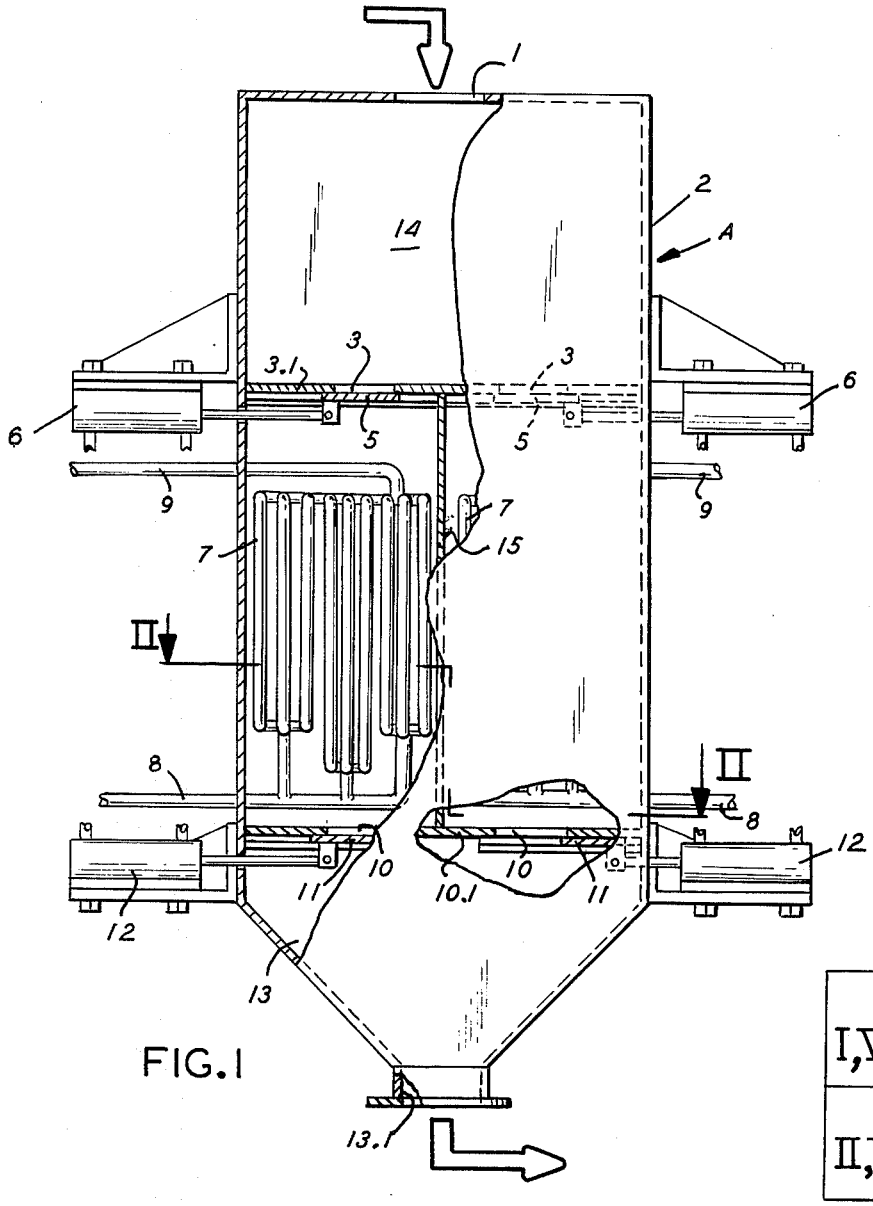
FIG. 1
| | |
|---|---|
| I,V | IV,VIII |
| II,VI | III,VII |
FIG. 3
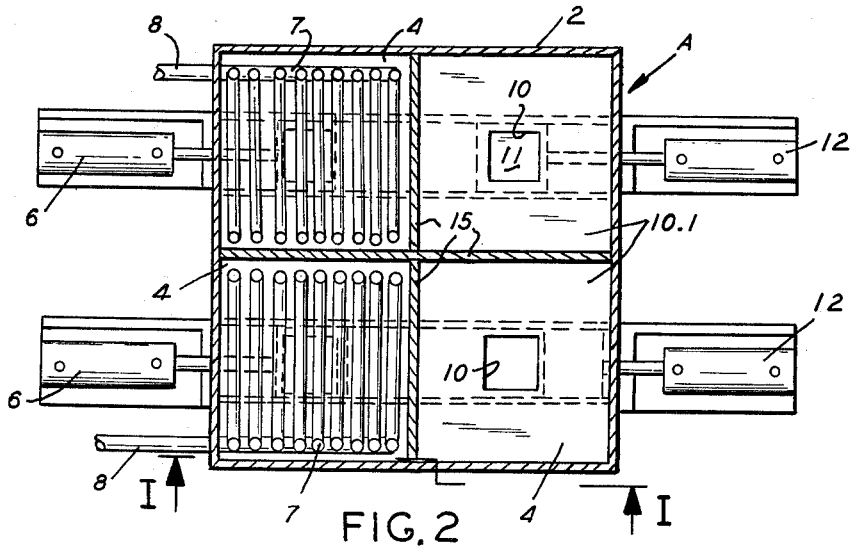
FIG. 2

METHOD OF COOLING RECOVERED SAND FOR CASTING PURPOSES AND APPARATUS THEREFOR

The present invention relates to a method of cooling recovered sand for casting purposes by cooling the recovered sand in a bunker by heat exchanger means, and a corresponding casting sand cooling apparatus.

In a heretofore known cooling apparatus for cooling recovered sand for casting purposes the bunker employed includes a heat exchanger that is intended to cool all of the sand supplied to the bunker, i.e. to cool the sand over the whole cross-sectional area of the bunker. Hot sand is more or less continuously supplied, and more or less cooled sand is discharged continuously or in batches. The sand that is to be cooled within the bunker is thus continuously in motion from the feed opening towards the discharge opening of the bunker. When increasing the discharge rate, the sand being cooled within the bunker likewise moves or "shifts" faster through the bunker. Additionally, this shifting movement of the sand through the bunker is highly irregular across the relatively large cross-sectional area of the bunker cavity. Inside the sand mass may form cavities, sand particles may tend to stick together. All of these effects will lead not only to uneven cooling of the sand but will result in many cases in an insufficient cooling which is due to the fact that the overall cooling efficiency coefficient is rather low.

It is now an object of the present invention to provide a novel and improved method of cooling recovered sand for casting purposes.

It is another object of the present invention to provide a novel and improved apparatus for cooling recovered sand for casting purposes.

It is still another object of the present invention to provide method and apparatus of the type stated above having an increased degree of cooling efficiency in comparison to prior art methods and apparatus, i.e. allowing an improved cooling of the recovered casting sand.

In accordance with the present invention, the proposed method of cooling recovered sand for casting purposes by cooling the recovered sand in a bunker by heat exchanger means comprises supplying the sand substantially continuously to the bunker and discharging the sand substantially continuously from the bunker whereby cooling of the sand is performed within discrete compartments of the bunker, and the sand within each compartment is at rest during a cooling cycle.

The proposed apparatus for cooling recovered sand for casting purposes comprises a bunker defining an internal cavity for receiving recovered sand, the bunker includes a top feed opening, a bottom discharge means, means for opening or closing the top and bottom openings, and internal heat exchanger means. The internal bunker cavity is subdivided by partition walls into a plurality of discrete adjacent compartments extending parallel to each other. Each of these compartments includes an upper inlet opening in communication with the bunker feed opening, and a bottom discharge opening in communication with the bunker discharge means. Each of the inlet and discharge openings is adapted to be closed or opened by an individually controllable gate means. A discrete heat exchanger means is disposed within each of the plurality of compartments.

In the apparatus of the present invention, the bunker is subdivided into several compartments which may sequentially be supplied with sand. After supplying sand to a compartment, the inlet and outlet openings thereof are closed so that the sand mass within the compartment remains substantially at rest and may be cooled intensively at this standstill condition by the heat exchanger of the compartment. Cooling continues until a desired temperature has been attained. Then the discharge opening of the compartment is opened, and the cooled sand contained in the compartment discharged from the compartment. The empty compartment is then again refilled with hot recovered sand. Several compartments are provided so that in practice there will always be available at least one compartment from which cooled sand may be discharged, in thus allowing a substantially or quasi continuous discharge of sand. Advantageously, the apparatus of the present invention includes several discrete adjacent compartments that are disposed side-by-side in what may be termed a horizontally stacked arrangement, and these compartments may be supplied selectively with sand. When the sand within a compartment has been cooled to a desired temperature, this compartment may be emptied by opening a corresponding discharge gate at the compartment. The empty compartment may then again by refilled with hot sand. Filling and emptying of the compartments is effected by gravity. The various compartments are filled with sand and emptied sequentially according to a suitably selected operational cycle. The actual cooling operation takes place while the sand mass in each compartment being in the cooling cycle of operation is substantially at a standstill to allow for an efficient heat transfer.

Already existing bunkers for casting sand not having any cooling devices may readily be modified by subdividing the bunker internal cavity into several compartments and installing a heat exchanger in every compartment. Modifications of this type generally present no difficulties and allow to greatly increase the capacity of equipment of this type.

Advantageously, the cross-sectional configuration of the bunker cavity corresponds either substantially to a square or to a rectangle, and the cavity is subdivided into at least four compartments having preferably substantially equal cross-sectional area. Generally, all of the compartments are of equal size and dimensions.

Further characteristics and the advantages of the present invention will be described in the following with reference to the appended drawing in which is illustrated a preferred embodiment of an apparatus in accordance with the present invention.

FIG. 1 is a schematical vertical sectional view of an embodiment of an apparatus for cooling sand in accordance with the present invention;

FIG. 2 is a transverse sectional view of the apparatus shown in FIG. 1, along the line II—II of FIG. 1; and FIG. 3 is a schematical view similar to FIG. 2 for illustrating the gate means arrangement.

Referring first to FIGS. 1 and 2, the apparatus of the present invention is generally indicated by the reference A and comprises a bunker 2 having a top feed opening 1. In the illustrating embodiment, the bunker 2 is subdivided into four compartments or chambers 4 by means of partition walls 15. Alternatively, the bunker 2 may be subdivided into, e.g., six compartments composed of a pair of parallel adjacent compartment rows of three compartments each, or into nine compartments defining jointly a square or a rectangular cross-sectional area. In every compartment 4 is disposed a heat exchanger 7 having a cooling-water inlet pipe 8 and a cooling-water outlet pipe 9. For clarity, FIG. 1 merely illustrates one heat exchanger 7 in an elevational view, and FIG. 2 merely illustrates the heat exchanger 7 of the two left hand compartments 4. Moreover, in FIG. 2 is shown merely the inlet pipe 8 of the heat exchanger 7 in the left hand bottom corner compartment, and the outlet pipe 9 of the heat exchanger 7 in the left hand top compartment 4; it will be understood, however, that every heat exchanger 7 is connected to individual inlet and outlet pipes 8 and 9.

The compartments 4 are provided at their top and bottom ends with top and bottom walls 3.1 and 10.1. Each compartment has a top inlet opening 3 and a bottom discharge opening 10. A collector or receiving chamber 14 common to all compartments is arranged within the internal cavity of the bunker in a space between the top feed opening 1 of the bunker 2 and the several inlet openings 3 of the compartments 4. In a similar manner, a discharge chamber of hopper 13 common to all compartments is disposed below the discharge openings 10 of the compartments. The bunker walls are tapered at hopper 13 toward the discharge port 13.1.

Each inlet opening 3 at a compartment 4 is provided with an inlet gate 5 that may be moved into a fully opened or into a fully closed, or into any desired intermediate opening position by means of an associated piston-cylinder operator 6 such as a double-acting hydraulic or pneumatic piston assembly. In a similar manner, the discharge opening 10 of each compartment may be opened or closed by as associated discharge gate 11 that is actuated by an associated piston-cylinder operator 12.

In FIG. 3, the top inlet gates of the four compartments are indicated by reference numerals I, II, III and IV, and the corresponding bottom discharge gates are indicated by the reference numerals V, VI, VII and VIII respectively. Inlet gate I thus corresponds to discharge gate V, gate II to gate VI. All of the gates may be actuated individually and/or sequentially according to a suitably selected predetermined cycle of operation by a program controller not shown.

In operation, the cooling of the casting sand may be performed with a sequential control of the inlet and outlet gates of the various compartments as follows:

a. Closing of gates IV and V concurrently with opening of gates I and VI. After a predetermined cooling interval that is dependent upon various operational parameters such as the temperature of the hot casting sand supplied to the apparatus, the desired temperature of the cooled sand discharged, the cooling capacity of the heat exchangers, the program controller initiates the next sequence.

b. Closing of gates I and VI and concurrently opening of gates II and VII. After a predetermined time interval the next sequence is initiated.

c. Closing of gates II and VII and concurrently opening of gates III and VIII. After a predetermined time interval the next sequence is initiated.

d. Closing of gates III and VIII and concurrently opening of gates IV and V. After a predetermined time interval the next following sequence is initiated.

This gate operation sequence or any other suitable gate opening and closing sequence will then be repeated.

Sand for reconditioning is supplied in a substantially continuous feed flow through the feed opening 1 of the bunker into the upper collector chamber 14 of the bunker 2. Upon opening of an inlet gate 5, sand is admitted into the respective compartment 4. After cooling, the sand is discharged from the compartment by opening the bottom discharge gate so that all of the sand contained in the respective compartment 4 may be discharged from the compartment and may enter the discharge hopper 13 from which the reconditioned sand will be discharged in a substantially continuous feed flow, due to the sequential operation of the various compartments.

During cooling operation, cooling water is continuously supplied to the heat exchangers 7 through the respective cooling water inlet pipes 8, and after having taken up more or less heat in the course of the heat exchange in the heat exchangers is again discharged through the cooling-water outlet pipes 9. All of the inlet pipes 8 may be connected to a common inlet manifold not shown, and all of the outlet pipes 9 may be connected to a common outlet manifold not shown. The inlet and outlet pipes 8, 9 or inlet and outlet manifolds respectively may be connected to a common cooling-water supply and to a common drainage system respectively. Alternatively if desired the cooling-water may be recycled whereby closed-circuit cooling would of course have to be provided.

What is claimed is:

1. An apparatus for cooling recovered sand for casting purposes, said apparatus comprising a bunker defining an internal cavity having sand-receiving and discharging chambers respectively disposed at the top and bottom of the internal cavity, the bunker having a top feed opening communicating with the sand-receiving chamber and also having a bottom discharge means for said sand discharging chamber, the bunker also having upright partition walls in the internal cavity and dividing the cavity into a plurality of discrete adjacent cooling compartments located between said receiving and discharging chambers, the bunker also having spaced transverse walls joining the upright partitions and defining top and bottom walls of said cooling compartment, the top wall having a plurality of upper inlet openings each communicating with a respective cooling compartment and with said sand-receiving chamber, the bottom wall having a plurality of bottom discharge openings each communicating with a respective cooling compartment and with said discharging chamber, said bunker also having heat exchanger means disposed within each of said cooling compartments, and a plurality of individually controllable and operable gate means at each of said inlet openings and discharge openings in said top and bottom walls and having power operated means for opening and closing individual gate means individually controlling the flow of sand through said openings into and out of said cooling compartments.

2. An apparatus as defined in claim 1, wherein the cross-sectional configuration of said bunker cavity corresponds substantially to a square, and said bunker cavity is subdivided into at least four discrete compartments having substantially equal cross-sectional area.

3. An apparatus as defined in claim 1, wherein the cross-sectional configuration of said bunker cavity is substantially rectangular, and said bunker cavity is subdivided into at least four discrete compartments having substantially equal cross-sectional area.

4. An apparatus for cooling recovered sand for casting purposes, said apparatus comprising a bunker defining an internal cavity having sand-receiving and discharging chambers respectively disposed at the top and bottom of the internal cavity, the bunker having a top feed opening communicating with the sand-receiving chamber and also having a bottom discharge means for said sand discharging chamber, the bunker also having upright partition walls in the internal cavity and dividing the cavity into a plurality of discrete adjacent cooling compartments located between said receiving and discharging chambers, the bunker also having spaced transverse walls joining the upright partitions and defining top and bottom walls of said cooling compartment, the top wall having a plurality of upper inlet openings each communicating with a respective cooling compartment and with said sand-receiving chamber, the bottom wall having a plurality of bottom discharge openings each communicating with a respective cooling compartment and with said discharging chamber, said bunker also having heat exchanger means disposed within each of said cooling compartments, a plurality of individually controllable and operable gate means at each of said inlet and discharge openings in said top and bottom walls and individually controlling the flow of sand through said openings into and out of said cooling compartments, a double-acting piston-cylinder assembly associated with each of said gate means, and all of said piston-cylinder assemblies being actuated by means of a program controller.

5. An apparatus as defined in claim 1, wherein all of said heat exchanger means of said plurality of compartments are connected to a common cooling-water supply.

* * * * *